United States Patent [19]

DiIoia

[11] Patent Number: 4,775,313

[45] Date of Patent: Oct. 4, 1988

[54] SCREED OPERATING APPARATUS

[76] Inventor: Michael A. DiIoia, 455 Hillcrest Ave., Somerset, N.J. 08873

[21] Appl. No.: 14,588

[22] Filed: Feb. 13, 1987

[51] Int. Cl.[4] ..... E01C 19/42

[52] U.S. Cl. ..... 425/458; 248/282; 249/219.1; 404/118; 425/63; 425/456

[58] Field of Search ..... 249/219 R; 425/62, 63, 425/64, 456, 458; 404/118, 119, 120; 248/278, 279, 282, 285, 286, 283

[56] References Cited

U.S. PATENT DOCUMENTS

| | | | |
|---|---|---|---|
| 1,648,913 | 11/1927 | Rathmell | 404/119 |
| 3,366,430 | 1/1968 | Diedrich | 248/285 |
| 4,319,314 | 3/1982 | Morton | 248/282 |
| 4,586,889 | 5/1986 | Krohne et al. | 248/219 R |

FOREIGN PATENT DOCUMENTS

| | | | |
|---|---|---|---|
| 2720392 | 11/1978 | Fed. Rep. of Germany | 248/285 |

*Primary Examiner*—Jay H. Woo

*Assistant Examiner*—James C. Housel

*Attorney, Agent, or Firm*—Robert A. Green

[57] ABSTRACT

The apparatus comprises a first horizontal bar adapted to be coupled to a building column and a second horizontal bar is rotatably coupled to and beneath the first bar. A bracket which can be coupled to a screed is coupled to the second bar so that it can rotate with respect to the second bar and it can slide with respect to the second bar. The apparatus is pivotably mounted on opposite columns in an area where a concrete floor is to be leveled and the brackets are coupled to the ends of a screed which the operators wish to move up to the columns and then move around the columns, all the while smoothing and leveling the concrete. The pivotability of the first bar and the rotatability of the second bar and the pivotability and slidability of the bracket with respect to the second bar, permits the operators to move the screed so that first one end thereof can be moved in front of its column and then to the other side of the column and then the second end of the screed can be moved in front of and to the other side of its column.

4 Claims, 3 Drawing Sheets

SCREED OPERATING APPARATUS

BACKGROUND OF THE INVENTION

At the present time, special problems exist in the construction industry and in the portion thereof relating to the pouring of concrete floors in warehouses and other large buildings. When such large buildings are intended to house computers, robots or other similar apparatus, flat or so-called super-flat floors are required to support these devices to insure their proper operation. The industry uses a device known as a vibrator screed for spreading and smoothing large areas of concrete since such a device helps cut costs by increasing the yardage of concrete which can be handled with minimal manpower.

A vibrator screed is particularly required in cases where a contractor purchases modern concrete having chemical additives which cause faster setting and hardening of the concrete.

A screed is essentially an elongated structure having a bottom bar which contacts and smooths the concrete. Screeds are adjustable in length and may be as long as 50 feet in length at the column lines. Thus, 20,000 square feet or more is an everyday routine pour. However, the smoothing of such large areas, particularly at the column lines, is a problem where one end of the screed bypasses one column and then the other end of the screed bypasses the column. Typically, when approaching the column on bulkheads, one end of the screed remains behind its column and the screed is tilted at about a 45° angle to permit the other end of the screed to move around its column. When this is done, the one end of the screed is then pushed past the column and the screed is returned to its parallel position on the main bulkhead and moves on in the concrete smoothing operation.

In order to move the screed around opposed columns, an extra temporary form is installed at each column at the same elevation as the main bulkhead. This form is 2"×4" or 2"×6" depending on the thickness of the floor. Usually, the length of such a form is 6 feet or more. The problem is that when the screed slides on or rests on the temporary form, the weight of the screed is not supported by the form and this produces a depression or dip in the floor which cannot be smoothed out and alters the level of the floor. Clearly, this is not acceptable where flat or super-flat floors are required.

SUMMARY OF THE INVENTION

Briefly, the apparatus of the invention comprises a pivotable horizontal bar to which a rotatable bar is secured and coupling means, to be secured to a screed, is slidably secured to the rotatable bar. This apparatus is secured to opposed columns up to which a screed is moved in conventional fashion as concrete is leveled thereby. Each apparatus is secured to one end of the screed and the combination of the parts of the apparatus which can pivot, rotate and slide, permit one end of the screed to be easily moved around one of the opposed columns and then the other end is moved around the other column and this is done while maintaining the level of the concrete.

DESCRIPTION OF THE INVENTION

Figure 1:
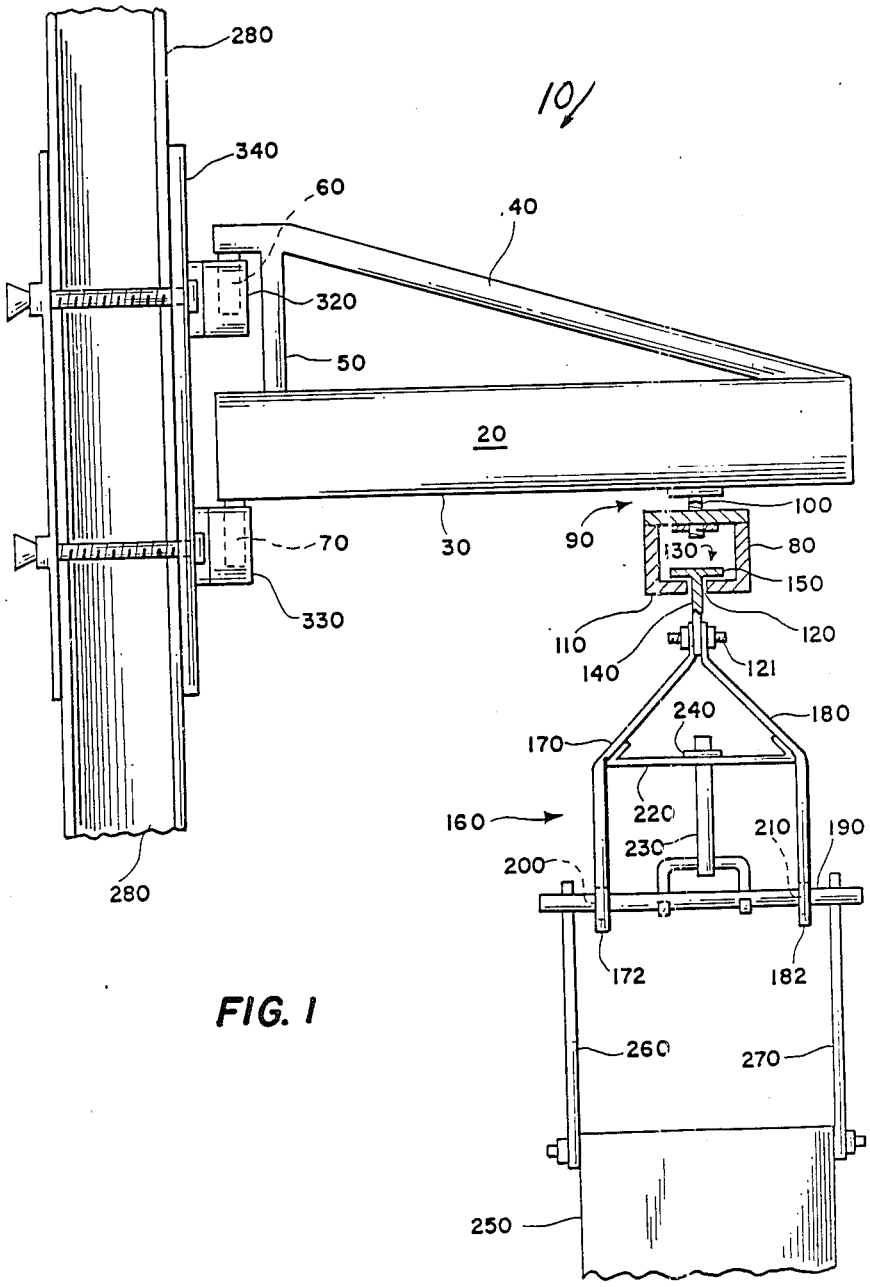
FIG. 1 is a side elevational viww, partly in section, of apparatus embodying the invention.
Figure 2:
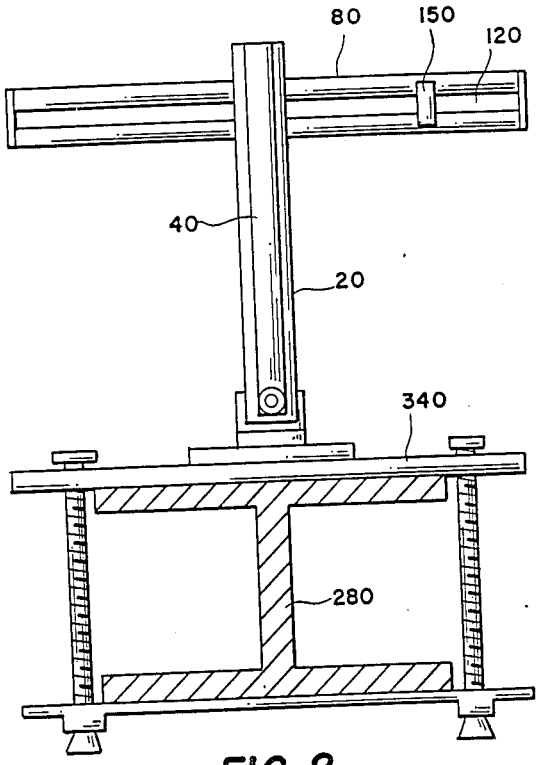
FIG. 2 is a plan view of a portion of the apparatus of FIG. 1.

Screed-coupling apparatus 10 embodying the invention comprises a first horizontal strong and rigid metal bar 20 of steel or the like which may be an I-beam or it may, if desired, have a U-shaped cross section. In any case the bar 20 has a lower horizontal wall or surface 30 which is horizontal and facing down. A mounting bar 40 is secured to the front end of the first metal bar 20 and extends rearwardly with an upward slope and at its rear end, it is suitably secured to the rear end of the first bar by means of vertical bar 50.

A vertical mounting post 60 extends downwardly from the rear end of the mounting bar 40 and a similar vertical mounting post 70 extends downwardly from the rear end of the first bar 20. The mounting posts 60 and 70 are vertically aligned so that they can be used to couple the apparatus 10 to a building column.

A second bar 80 is rotatably secured to the first bar 20 and is horizontally disposed beneath the first bar. Any suitable arrangement 90 may be used to rotatably couple the second bar 80 to the first bar and in one arrangement, the first bar 20 carries a vertical post 100 to which bar 80 is rotatably coupled. The second bar 80 is also of steel or the like and may also be U-shaped, if desired, in which case it would include a solid, horizontal lower wall 110. The solid wall 110 of the second bar is provided with a longitudinal slot 120 which extends along substantially its entire length and a T-shaped metal bracket 130 is slidably and rotatably disposed in the slot 120 with its vertical wall or post 140 in the slot and extending below the wall 110 of the bar and its cross wall or post 150 seated on the inner surface of the wall 110 whereby the bracket is held in place.

A bracket 160 to be secured to a screed is rotatably and slidably coupled to the vertical wall 140 of the T-shaped bracket 130 beneath the second bar. This bracket 160 includes two metal bars 170 and 180 secured together at their upper ends, which ends are secured to the vertical wall 140 of the bracket 130 in any suitable manner, for example by means of a bolt 121. The two bars 170 and 180 are spread apart as they proceed downwardly and at their lower ends 172 and 182 they carry a horizontal rod 190 which is seated in vertical elongated slots 200 and 210 in the bars 170 and 180. In addition, a horizontal bar 220 is secured between the two bars 170 and 180 at about their centers and a threaded rod 230 extends downwardly to and is secured to the horizontal rod 190. A wing nut 240 is threaded on the upper end of the vertical rod 230 and this is used to raise and lower the horizontal rod 190 and thus to adjust the coupling between the bracket 160 and the screed 250.

For connection of the bracket 160 to the screed 250, two vertical bars 260 and 270 are coupled at their upper ends to the ends of the horizontal rod 190 and their lower ends are secured to the screed 250 to be moved.

In using the invention, the screed 250 is moved up to opposed columns 280 and 290 about which it is to be moved and this movement is carried out in any suitable manner. Usually, the screed moves along opposed rails or bulkheads 300 and 310 which extend between the columns and define the edges of the concrete being leveled by the screed. The apparatus 10 of the invention is mounted on the opposed columns, which may be I-beams, by placing the vertical posts 60 and 70 in vertical tubes 320 and 330 which are held on the columns in any suitable fashion. For example, the tubes 320 and 330 may be secured to metal plate(s) 340 which themselves are bolted or otherwise secured to the columns. This arrangement permits the entire assembly 10 to pivot with respect to the columns.

Figure 4:
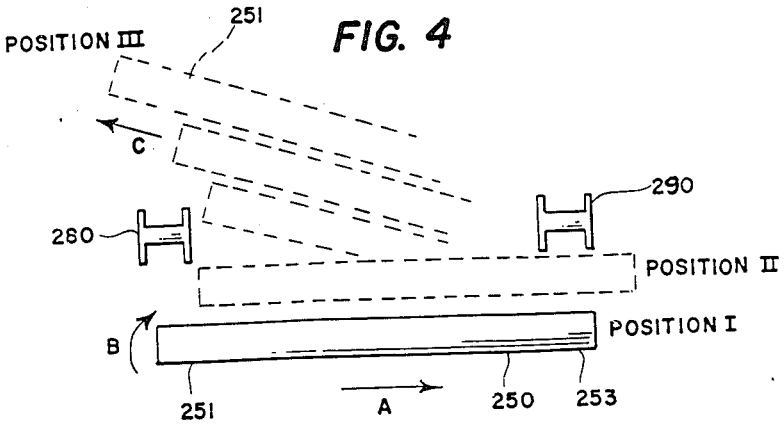
FIG. 4 is a plan view of some of the apparatus of FIG. 3 illustrating schematically, in dash lines, the manipulation of a screed by the apparatus of the invention.
Figure 3:
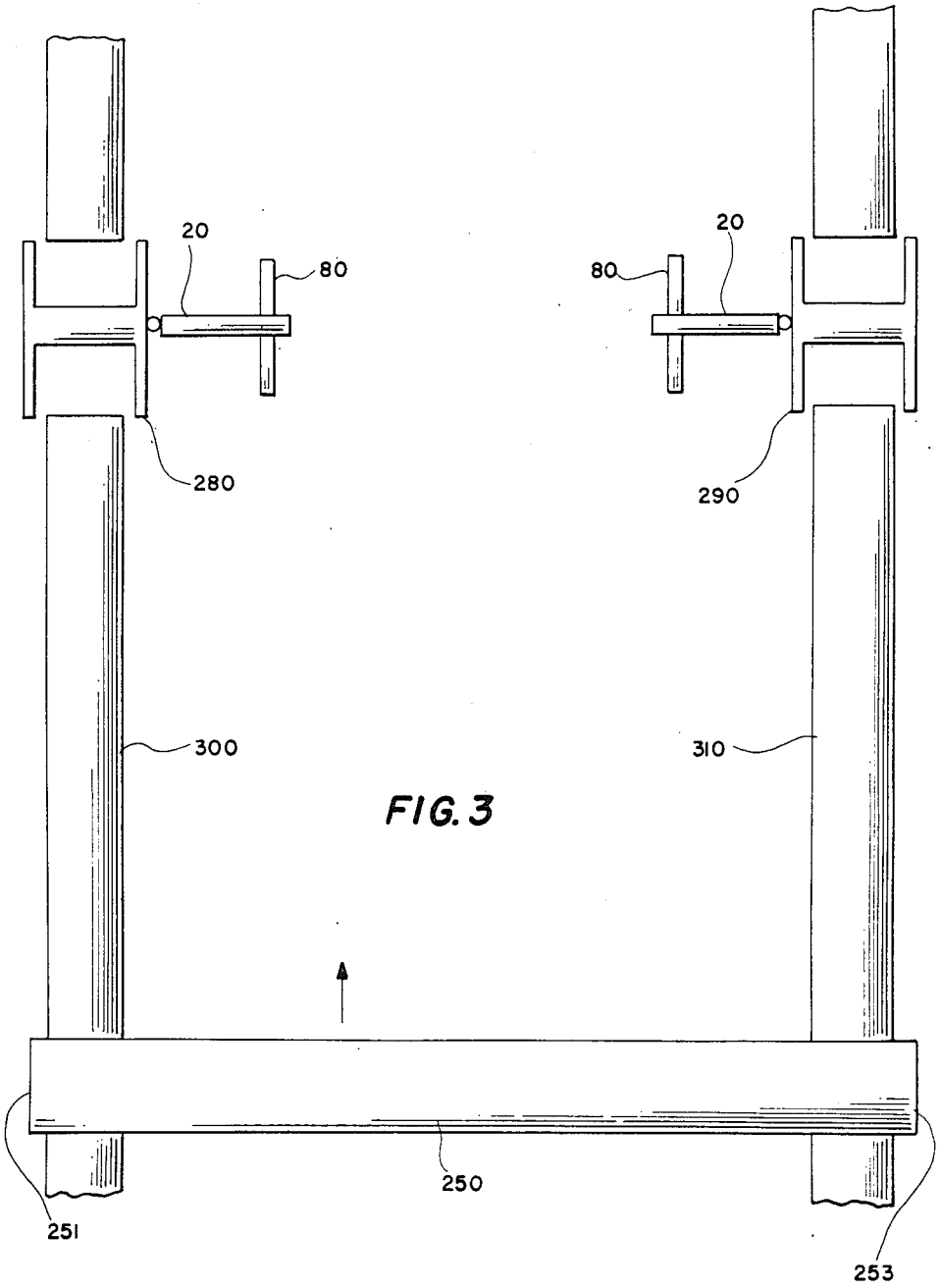
FIG. 3 is a plan view of apparatus illustrating the operation of the invention.

With the screed 250 close to the opposed columns 280 and 290, position I in FIG. 4, both of the coupling apparatus 10 on the columns are coupled to the screed through the bracket 160 and bars 260 and 270. The wing nuts 240 on the brackets 160 are suitably adjusted to act through rods 190 provide the proper coupling tension between the bars 260 and 270 and the screed and then by sliding the brackets 160 along their slots 120 in the horizontal bars 80, the screed is moved to the right as seen in FIG. 4, in the direction of arrow A, to position II, so that the left end 251 is positioned so that it can clear its column. This is illustrated in dash lines for end 251 in FIG. 4. Then, by suitably rotating and pivoting the first and second bars 20 and 80, the left end 251 of the screed is moved in front of the column 280, as indicated by arrow B, and beyond this column as illustrated in dash lines in FIG. 4. Next, the screed is pushed in a leftward direction, as indicated by arrow C, to place the left end on the other side of the column 280, position III, and this moves the right end 253 in front of its column 290. Now, the right end 253 can be moved in front of its column 290 and into position on the other side of this column. Now the screed is in position, like position I, to travel along the rails 300 and 310 to the next pair of opposed columns to which both apparatus 10 are coupled to repeat the operation described above.

The advantages of the invention are that the apparatus is easy to handle and easy and practical to install on a column and detach from a column. In addition, the apparatus of the invention will positively eliminate the problems of uneven floors at critical column lines, it will save the expense of placement for temporary forms at the columns, carpenter's time, and extra concrete finishers' time for the removal of such forms. It also eliminates the need for extra steel pins or wooden pegs, the cost of additional lumber, labor time for maintenance of lumber, possible unsatisfactory workmanship, loss of prestige of the contractor and his reputation leading to the loss of recommendations and jobs.

What is claimed is:

1. Screed manipulating apparatus comprising a first horizontal bar having a first end and a second end and means at said first end by which the bar can be pivoted for horizontally and pivotably supporting said bar such that said bar is pivotable in a horizontal plane, a second horizontal bar rotatably coupled to said first horizontal bar and disposed beneath said first bar, coupling means attached to said second bar for coupling an end of a screed to said second bar, the attachment of said coupling means permitting said coupling means to slide along substantially the entire length of said second horizontal bar, the arrangement and inter-coupling of said first horizontal bar, said second horizontal bar and said coupling means being such that a screed can be moved around a vertical column while it is performing its function of leveling concrete, said coupling means comprising a bracket having one end coupled to said second horizontal bar and having its other end provided with means for engaging a screed, and said bracket comprising two bars having their upper ends coupled to said second horizontal bar and their lower ends spread apart and carrying a horizontal rod which carries vertical bars adapted to be coupled to a screed.

2. The apparatus defined in claim 1 wherein said bracket includes means for adjusting the position of said horizontal rod and thereby adjusting the position of said bracket with respect to a screed to which it is coupled.

3. Building construction apparatus for leveling concrete on a floor having a first structural vertical column and a second vertical structural column disposed therein opposite each other, said apparatus comprising a screed which is longer than the space between said first and second columns, screed support rails in the floor leading up to and away from said columns for supporting said screed as it is moved up to and away from said columns, a first screed support apparatus secured to said first column and to one end of said screed and a similar second screed support apparatus secured to said second column and to the other end of said screed, each of said first and second screed support apparatus comprising a first horizontal bar having a first end and a second end and means at said first end by which the bar can be pivoted in a horizontal plane, a second horizontal bar rotatably coupled to said first horizontal bar and disposed beneath said first bar, and coupling means attached to said second bar for coupling to the ends of a screed, the attachment of said coupling means to said second bar being slidable, the arrangement and inter-coupling of said first horizontal bar, said second horizontal bar and said coupling means being such that a screed can be moved around a vertical column while it is performing its function of leveling concrete.

4. Screed manipulating apparatus comprising a first horizontal bar having a first end and a second end and means at said first end by which the bar can be pivoted for horizontally and pivotably supporting said bar such that said bar is pivotable in a horizontal plane, a second horizontal bar rotatably coupled to said first horizontal bar and disposed beneath said first bar, said second horizontal bar having a slot extending along its length, and coupling means attached to said second horizontal bar for slidably coupling an end of a screed to the second bar, said coupling means comprising a bracket having a portion coupled to said second horizontal bar and slidably seated in said slot whereby said coupling means can slide along said second bar, said bracket including two bars having their upper ends coupled to said second horizontal bar and in the slot therein, said two bars having their lower ends spread apart and carrying a horizontal rod which carries vertical bars adapted to be coupled to a screed.

* * * * *